US010794229B2

(12) United States Patent
Takahashi et al.

(10) Patent No.: US 10,794,229 B2
(45) Date of Patent: Oct. 6, 2020

(54) BINARY POWER GENERATION SYSTEM AND STOPPING METHOD FOR SAME

(71) Applicant: KOBE STEEL, LTD., Hyogo (JP)

(72) Inventors: Kazuo Takahashi, Kobe (JP); Yuji Tanaka, Takasago (JP); Shigeto Adachi, Takasago (JP); Yutaka Narukawa, Takasago (JP); Kazumasa Nishimura, Takasago (JP)

(73) Assignee: Kobe Steel, Ltd., Hyogo (JP)

( * ) Notice: Subject to any disclaimer, the term of this patent is extended or adjusted under 35 U.S.C. 154(b) by 0 days.

(21) Appl. No.: 16/480,321

(22) PCT Filed: Jan. 18, 2018

(86) PCT No.: PCT/JP2018/001297
§ 371 (c)(1),
(2) Date: Jul. 24, 2019

(87) PCT Pub. No.: WO2018/147027
PCT Pub. Date: Aug. 16, 2018

(65) Prior Publication Data

US 2019/0383176 A1 Dec. 19, 2019

(30) Foreign Application Priority Data

Feb. 8, 2017 (JP) ..... 2017-020997

(51) Int. Cl.
*F01K 23/04* (2006.01)
*F01D 17/08* (2006.01)
(Continued)

(52) U.S. Cl.
CPC ..... *F01K 23/04* (2013.01); *F01D 17/08* (2013.01); *F01D 21/00* (2013.01); *F01K 25/10* (2013.01); *F04D 15/00* (2013.01); *F04D 29/66* (2013.01)

(58) Field of Classification Search
CPC ..... F01K 23/04; F01K 25/10; F01D 17/08; F01D 21/00; F04D 15/00; F04D 29/66
See application file for complete search history.

(56) References Cited

U.S. PATENT DOCUMENTS 6,296,459 B1 * 10/2001 Saputo ..... F04D 25/084 417/423.14
7,036,315 B2 * 5/2006 Kang ..... F01K 23/101 60/646

(Continued)

FOREIGN PATENT DOCUMENTS

JP 2002-372343 A 12/2002
JP 2012-202269 A 10/2012

OTHER PUBLICATIONS

Notification of Transmittal of Translation of the International Preliminary Report on Patentability (Chapter I) and Translation of Written Opinion of the International Searching Authority, PCT/JP2018/001297, dated Aug. 22, 2019.

*Primary Examiner* — Shafiq Mian
(74) *Attorney, Agent, or Firm* — Studebaker & Brackett PC

(57) ABSTRACT

A binary cycle power generation system includes a working fluid circulation line, an evaporator, an expander, an energy recovery apparatus, a condenser, and a pump. The pump includes a casing, a rotary shaft, and impellers. The casing is hollow and has an end wall at an end in a longitudinal direction. The rotary shaft has an axis extending in the longitudinal direction of the casing, is supported on the end wall, has at least a part that is in the casing, and rotates owing to a torque. The impellers are attached to the rotary shaft one after another in the longitudinal direction. The pump is arranged in such a way that the axis of the rotary shaft intersects a vertical direction.

5 Claims, 8 Drawing Sheets

(51) Int. Cl.

| | |
|---|---|
| ***F01D 21/00*** | (2006.01) |
| ***F01K 25/10*** | (2006.01) |
| ***F04D 15/00*** | (2006.01) |
| ***F04D 29/66*** | (2006.01) |

(56) References Cited

U.S. PATENT DOCUMENTS

| | | | | |
|---|---|---|---|---|
| 7,775,045 | B2 * | 8/2010 | Kaplan | F01K 25/08 60/641.2 |
| 8,186,161 | B2 * | 5/2012 | Ast | F01K 23/101 60/660 |
| 8,407,998 | B2 * | 4/2013 | Ernst | F02G 5/02 60/616 |
| 8,813,498 | B2 * | 8/2014 | Kopecek | F01K 13/02 60/653 |

* cited by examiner

BINARY POWER GENERATION SYSTEM AND STOPPING METHOD FOR SAME

TECHNICAL FIELD

The present invention relates to a binary cycle power generation system and a method for stopping the system, and particularly, relates to a binary cycle power generation system including a multistage centrifugal pump, and a method for stopping the system.

BACKGROUND ART

Study and Development have recently been done to binary cycle power generation systems fulfilling as one of thermal energy recovery systems (e.g., Patent Literature 1). Such a binary cycle power generation system includes an evaporator, an expander, a condenser and a pump arranged in this order in a circulation line of a working fluid, and a power generator is connected to the expander. The evaporator evaporates the working fluid owing to gained steam or warm water. The expander expands the working fluid evaporated in the evaporator. The condenser condenses the working fluid coming from the expander owing to a heat exchange with cooling water.

The binary cycle power generation system having this configuration which uses a working fluid having a boiling point lower than that of water to drive an expander makes it possible to generate power in a lower temperature range than a conventional power generation system which drives an expander directly by steam.

CITATION LIST

Patent Literature

Patent Literature 1: Japanese Unexamined Patent Publication No. 2012-202269

SUMMARY OF INVENTION

However, the binary cycle power generation system according to the conventional technology has a problem that a cavitation occurs in a casing of the pump when the system is stopped in a state that the condenser has a high temperature, and then restarted. Specifically, when the system is stopped in the state that the condenser has a high temperature, the pressure rapidly decreases because the circulation of the working fluid stops, but the temperature in the condenser remains high, so that the working fluid comes into a saturation state. The working fluid at a suction port of the pump provided at a downstream position of the condenser consequently comes into the saturation state.

When the system is restarted and the pump is driven in the saturation state of the working fluid at the suction port of the pump, the working fluid at the suction port comes into a superheated state, so that a cavitation occurs in the casing. The occurrence of the cavitation in the casing of the pump leads to malfunction of the system or damage to the pump.

The present invention has been achieved to solve the above-described problems, and an object of the present invention is to provide a binary cycle power generation system which can prevent a cavitation from occurring in a pump in the restarting of the system.

A binary cycle power generation system according to an aspect of the present invention includes a working fluid circulation line, an evaporator, an expander, an energy recovery apparatus, a condenser, and a pump.

The working fluid circulation line is a line through which a working fluid circulates.

The evaporator is a structural component which is provided in the working fluid circulation line, and evaporates the working fluid owing to a gained thermal energy.

The expander is a structural component which is provided at a downstream side with respect to the evaporator in the working fluid circulation line, and expands the working fluid coming from the evaporator.

The energy recovery apparatus is a structural component which recovers a kinetic energy generated in the expander.

The condenser is a structural component which is provided at a downstream side with respect to the expander in the working fluid circulation line, and condenses the working fluid coming from the expander owing to a heat exchange with a cooling medium.

The pump is a structural component which is provided at a position downstream of the condenser and upstream of the evaporator in the working fluid circulation line, and causes the working fluid coming from the condenser to go to the evaporator.

The pump includes a casing, a rotary shaft, and impellers.

The casing is hollow and has an end wall at an end in a longitudinal direction.

The rotary shaft is a structural component which has an axis extending in the longitudinal direction, which is supported on the end wall, at least a part of which is in the casing, and which rotates owing to a torque.

The impellers are structural components attached to the rotary shaft one after another in the longitudinal direction.

The pump is arranged in such a way that the axis of the rotary shaft intersects a vertical direction.

DESCRIPTION OF EMBODIMENTS

Hereinafter, embodiments will be described with reference to the accompanying drawings. It should be noted that the embodiments described below each merely represents an aspect of the present invention. Therefore, the present invention should not be limited to the embodiments except for essential configurations.

First Embodiment

1. Overall Configuration

An overall configuration of a binary cycle power generation system 1 according to a first embodiment will be described with reference to FIG. 1.

Figure 1:
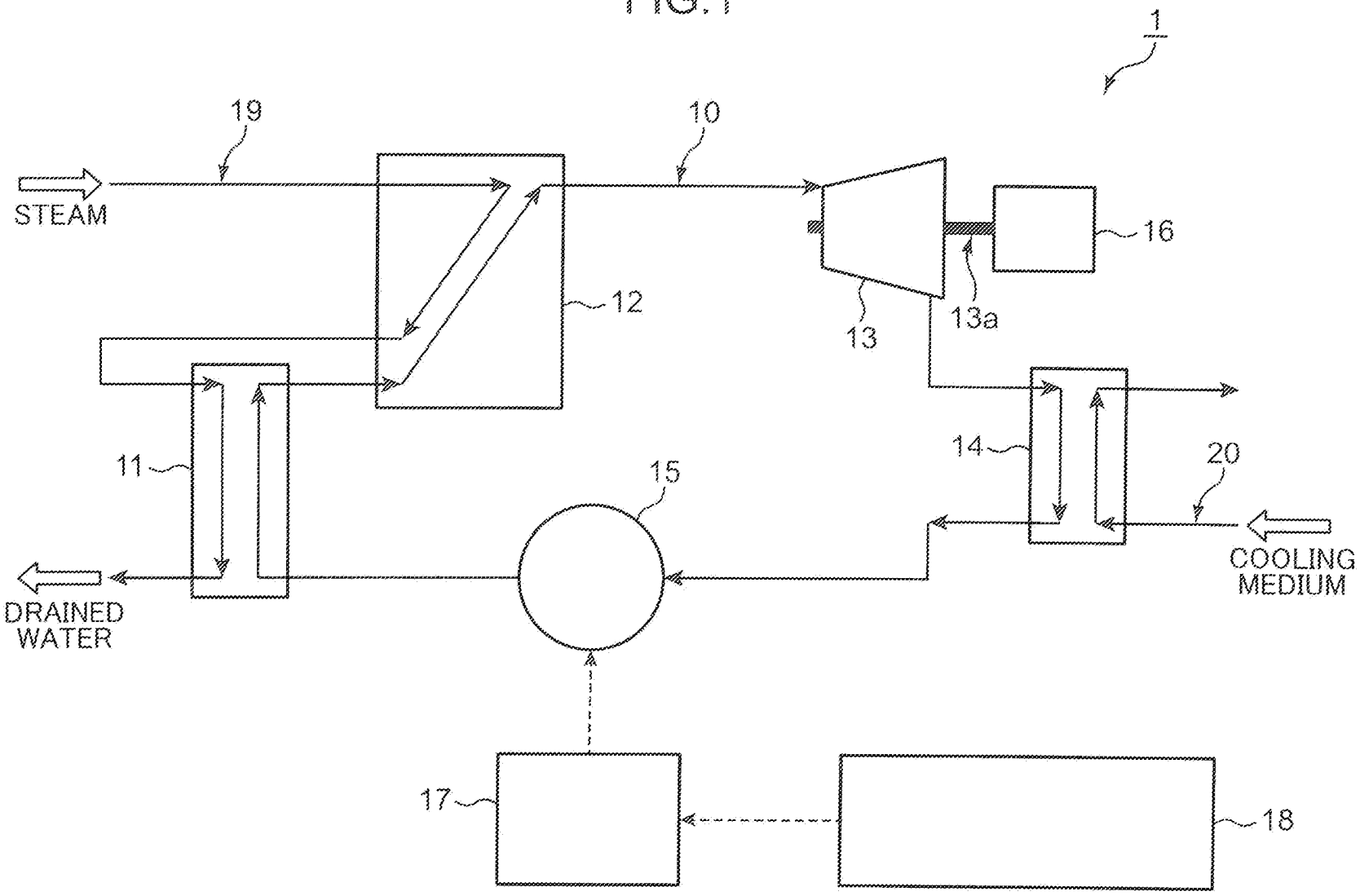
FIG. 1 is a schematic diagram showing an overall configuration of a binary cycle power generation system according to a first embodiment.

As shown in FIG. 1, the binary cycle power generation system 1 according to the first embodiment includes a working fluid circulation line 10, a preheater 11, an evaporator 12, an expander 13, a condenser 14, a pump 15, a power generator (energy recovery apparatus) 16, an inverter 17, and a controller (control unit) 18.

The working fluid circulation line 10 is a line through which a working fluid circulates. Adopted as the working fluid is a fluid which has a lower boiling point than water and boils at room temperature, for example, a substitute Freon (e.g., HFC 245fa), a mixed liquid of ammonia and water, and an organic substance such as isopentane and isobutane. For instance, HFC 245fa is a medium which has a boiling point of 15.3 [° C.] and evaporates at room temperature.

Each of the preheater 11 and the evaporator 12 is a heat exchanger having the principle of countercurrent devices. Specifically, the preheater 11 and the evaporator 12 cause the working fluid to flow in the opposite direction to a direction in which steam or warm water passes through a steam supply line 19. The preheater 11 preheats the working fluid, and thereafter the evaporator evaporates the working fluid.

The expander 13 is provided at a downstream position (at a downstream position in the flow direction of the working fluid) of the evaporator 12 in the working fluid circulation line 10. The expander 13 expands the working fluid coming from the evaporator 12. Although the details of the expander 13 are not shown in the drawings, a positive displacement screw expander including a pair of male and female screw rotors is adopted as the expander 13 in this embodiment.

The expander 13 has a pair of rotors to be driven owing to an expansion energy of the working fluid coming in a gaseous state. The expander 13 has a rotary shaft 13*a* connected to one of the pair of screw rotors, extending outward, and having an end connected to the power generator 16.

The power generator 16 serves as an energy recovery apparatus in the binary cycle power generation system 1 according to this embodiment. The power generator 16 generates power owing to a torque produced by the expander 13. In this manner, the thermal energy of the supplied steam is acquired.

The condenser 14 is provided at a downstream position of the expander 13 in the working fluid circulation line 10. The condenser 14 is a countercurrent-type heat exchanger in which the working fluid coming in the gaseous state from the expander 13 and cooling medium (e.g., cooling water) passing through a cooling medium circulation line 20 flow in the opposite directions and exchange heat with each other. The condenser 14 cools and condenses the working fluid coming in the aforementioned manner, and the condensed working fluid goes to the pump 15 in the liquid state.

The pump 15 is provided at a position downstream of the condenser 14 and upstream of the preheater 11 in the working fluid circulation line 10. The pump 15, which will be described in detail later, includes a multistage centrifugal pump having a motor and a plurality of impellers rotated by the motor. The pump 15 pressurizes the working fluid having entered therein to reach a predetermined value, and then causes the pressurized working fluid to flow into the preheater 11.

The inverter 17 is a device for driving the motor of the pump 15 at a variable speed. The inverter 17 changes the speed of the motor by changing the frequency of power supplied to the motor of the pump 15.

The controller 18 outputs to the inverter 17 an instruction of changing the speed of the pump 15 in accordance with input information.

2. Configuration and Arrangement of Pump 15

Figure 2:
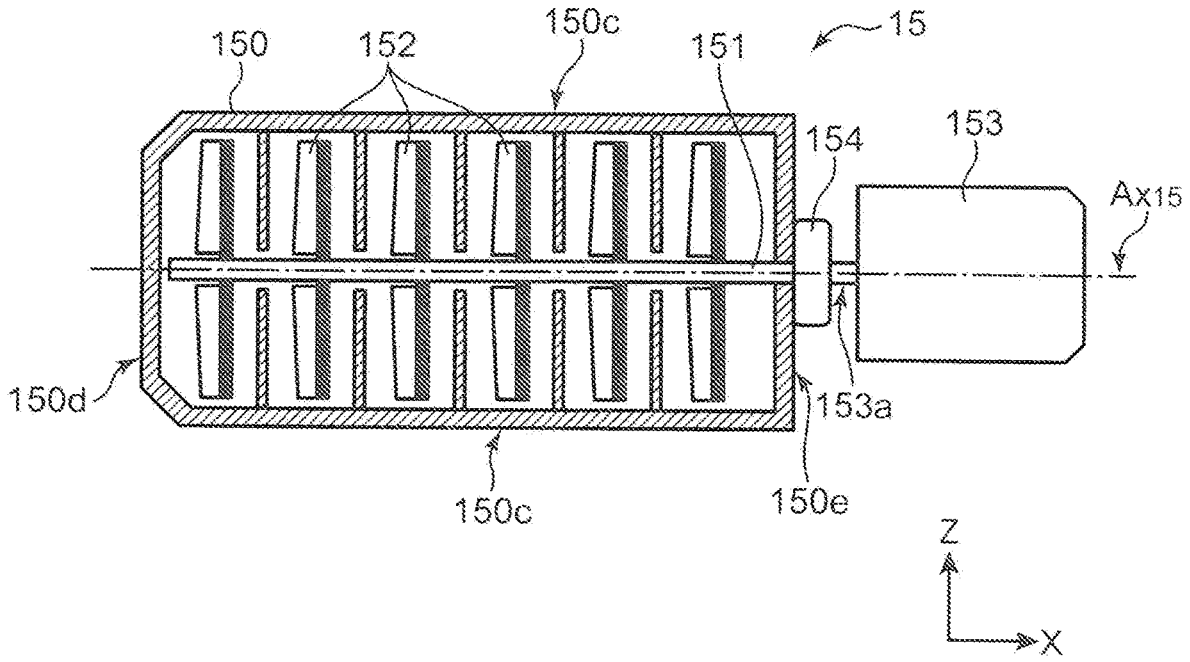
FIG. 2 is a schematic cross-sectional side view showing a configuration and arrangement of a pump in the first embodiment.
Figure 3:
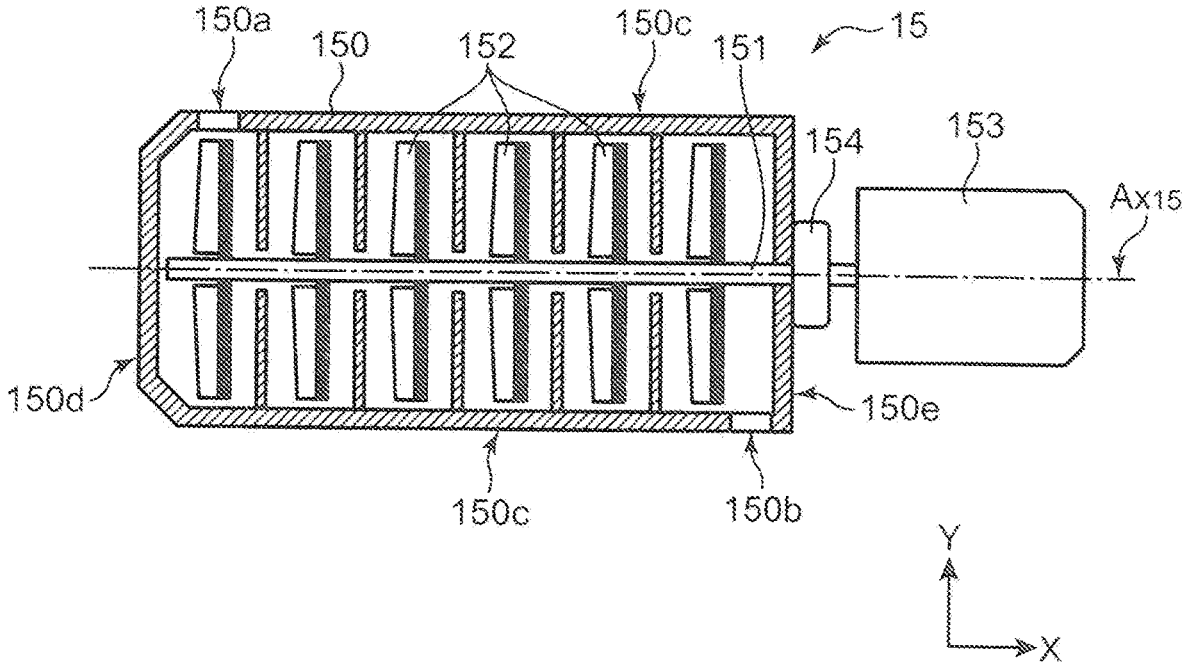
FIG. 3 is a schematic cross-sectional top view showing the configuration and the arrangement of the pump in the first embodiment.
Figure 4:
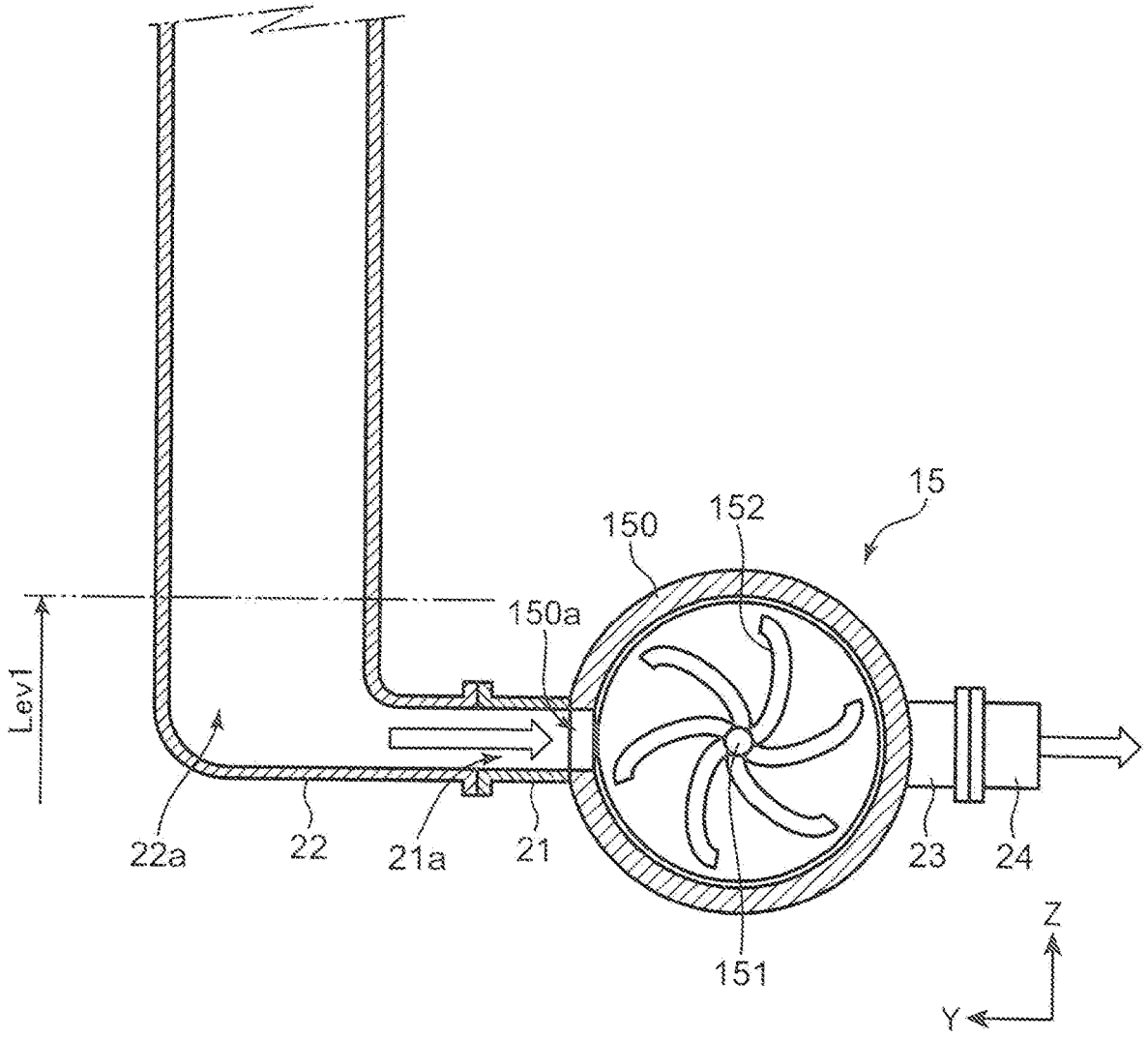
FIG. 4 is a schematic cross-sectional end view showing the configuration and the arrangement of the pump in the first embodiment.

A configuration and an arrangement of the pump 15 in the binary cycle power generation system 1 according to this embodiment will be described with reference to FIGS. 2 to 4. FIG. 2 is a schematic cross-sectional side view showing the configuration and the arrangement of the pump 15. FIG. 3 is a schematic cross-sectional top view showing the configuration and the arrangement of the pump 15. FIG. 4 is a schematic cross-sectional end view showing the configuration and the arrangement of the pump 15.

As shown in FIGS. 2 and 3, the pump 15 includes a casing 150, a rotary shaft 151, a plurality of impellers 152, a motor (drive source) 153, and a bearing 154.

The casing 150 has a peripheral wall 150*c* forming a hollow cylinder, and an end wall 150*d* and another end wall 150*e* at the opposite ends in a longitudinal direction. As shown in FIGS. 2 and 3, the casing 150 has a cylindrical shape which is longer in the longitudinal direction (X direction) than in a radial direction (Y, Z direction).

The rotary shaft 151 has an axis $Ax_{15}$ extending in the X direction (horizontal direction). The rotary shaft 151 has an end extending outward through the end wall 150*e* of the casing 150 on the right in the X direction. The end of the rotary shaft 151 extending outward from the casing 150 is connected to a drive shaft 153*a* of the motor 153 serving as a drive source.

The bearing 154 is attached to an outer surface of the end wall 150*e* of the casing 150, and supports the rotary shaft 151 in a state that the axis $Ax_{15}$ is kept in a horizontal posture (posture in the X direction). In other words, one end of the rotary shaft 151 is supported on the end wall 150*e* in this embodiment. However, both ends of the rotary shaft 151 may be supported respectively on the end wall 150*d* and the end wall 150*e*.

Although the pump 15 is arranged in such a way that the $Ax_{15}$ of the rotary shaft 151 extends in the horizontal direction in the binary cycle power generation system 1 according to this embodiment, the $Ax_{15}$ of the rotary shaft 151 may permissibly intersect a vertical direction (Z direction) at other angles. For example, the axis $Ax_{15}$ of the rotary shaft 151 may intersect the vertical direction (Z direction) at an angle of 75° or more to less than 90°.

The plurality of impellers 152 are attached to a part of the rotary shaft 151 that is accommodated in the casing 150 one after another in the X direction. The plurality of impellers 152 rotate integrally with the rotary shaft 151 owing to the torque of the motor 153.

As shown in FIG. 3, the peripheral wall 150*c* of the casing 150 is formed with a suction port 150*a* and a discharge port 150*b*. The suction port 150*a* is formed in the left of the peripheral wall 150*c* (closer to the end wall 150*d*) in the X direction. The discharge port 150*b* is formed in the right of the peripheral wall 150*c* (closer to the end wall 150*e*) in the X direction.

As shown in FIG. 4, the suction port 150*a* of the pump 15 is connected with a pipe 22 via a suction port pipe 21, and the discharge port 150*b* (not shown in FIG. 4) is connected to a pipe 24 via a discharge port pipe 23.

The working fluid coming in the liquid state from the condenser 14 is introduced into the casing 150 of the pump 15 after passing through an inside passage 22*a* of the pipe 22 and an inside passage 21*a* of the suction port pipe 21. The introduced working fluid advances in a rearward direction of FIG. 4 on the paper while being pressurized by the rotating impellers 152. Thereafter, the pressurized working fluid passes through the discharge port pipe 23 and the pipe 24, and goes to the preheater 11.

Here, as shown in FIG. 2, the pump 15 in this embodiment is arranged in the horizontal posture in such a way that the axis $Ax_{15}$ of the rotary shaft 151 extends in the horizontal direction (X direction). This arrangement sufficiently enables the working fluid to reach the discharge port 150*b* while being pressurized by the pump 15, even when a liquid surface of the working fluid is at a low level or Level 1 as shown in FIG. 4.

3. Configuration and Arrangement of Comparative Pump 95

A configuration and an arrangement of a comparative pump 95 will be described with reference to FIG. 5 in comparison with the above-described configuration and arrangement of the pump 15.

Figure 5:
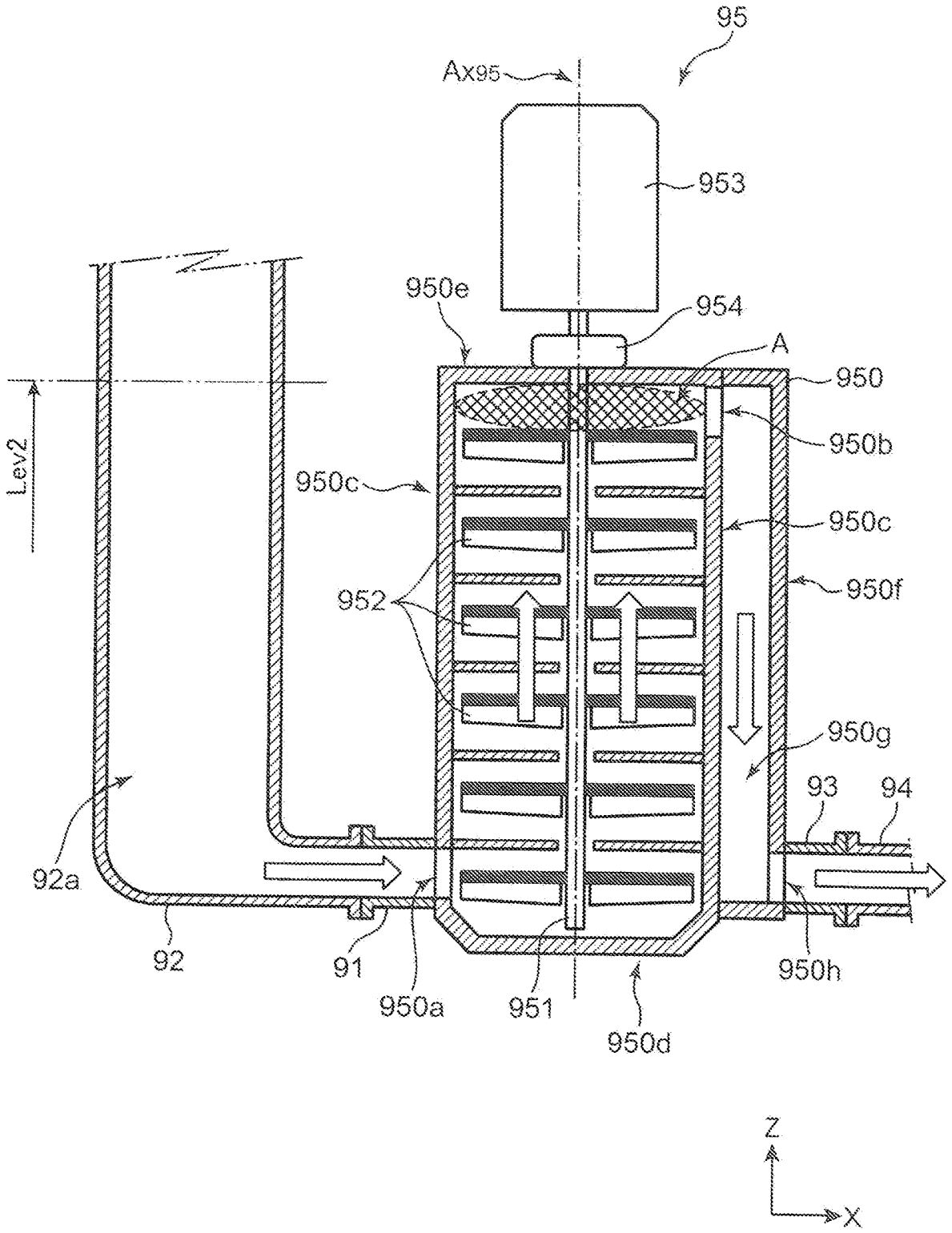
FIG. 5 is a cross sectional view showing a configuration and an arrangement of a comparative pump.

As shown in FIG. 5, the comparative pump 95 similarly includes a casing 950, a rotary shaft 951, a plurality of impellers 952, a motor 953, and a bearing 954. The rotary shaft 951, the impellers 952, the motor 953, and the bearing 954 among the components have no structural change from the rotary shaft 151, the impellers 152, the motor 153, and the bearing 154 respectively of the above-described pump 15. Thus, the description for these components will be omitted.

The casing 950 of the pump 95 includes a peripheral wall 950*c* forming a hollow cylinder, an end wall 950*d* and another end wall 950*e* at the opposite ends in a longitudinal direction, and an outer wall 950*f* which extends along a part of the peripheral wall 950*c* to define a discharge passage 950*g* with the part of the peripheral wall 950*c* therebetween.

The peripheral wall 950*c* of the casing 950 is formed with a suction port 950*a* at a lower position thereof (closer to the end wall 950*d*) in a Z direction, and is formed with a discharge port 950*b* at an upper position thereof (closer to the end wall 950*e*) in the Z direction. The outer wall 950*f* of the casing 950 is formed with an outer discharge port 950*h* at a lower position thereof in the Z direction.

As shown in FIG. 5, the comparative pump 95 is arranged in a vertical posture in such a way that an axis $Ax_{95}$ of the rotary shaft 951 extends in the Z direction (vertical direction). In this arrangement, the suction port 950*a* is at a lower position and the discharge port 950*b* is at a higher position of the casing 950 in the Z direction.

The suction port 950*a* is connected with a pipe 92 via a suction port pipe 91, and the outer discharge port 950*h* is connected with a pipe 94 via the discharge pipe 93.

The working fluid coming from the condenser is introduced into the casing 950 from the suction port 950*a* after passing through an inside passage 92*a* of the pipe 92 and a suction port pipe 91. The introduced working fluid then advances upward in the Z direction while being pressurized by the rotating impellers 952. Thereafter, the pressurized working fluid flows out from the discharge port 950*b*, advances in the discharge passage 950*g*, further flows out from the outer discharge port 950*h*, passes through the discharge port pipe 93 and the pipe 94, and goes to the preheater.

4. Advantageous Effects

Hereinafter, advantageous effects of the binary cycle power generation system 1 according to the first embodiment will be described in comparison with a system including the comparative pump 95 shown in FIG. 5.

4-1. First Embodiment

As described with reference to FIGS. 2 to 4, the pump 15 is arranged in the horizontal posture in such a way that the axis $Ax_{15}$ of the rotary shaft 151 extends in the substantially horizontal direction in the binary cycle power generation system 1 according to the first embodiment. The binary cycle power generation system 1 thus can prevent a cavitation from occurring in the casing 150 of the pump 15 in the restarting of the binary cycle power generation system 1 more effectively than a system including the comparative pump 95 arranged in the vertical posture in such a way that the $Ax_{95}$ of the rotary shaft 951 extends in the vertical direction (Z direction).

Specifically, the binary cycle power generation system 1 according to the first embodiment including the pump 15 arranged in the horizontal posture allows the working fluid to flow from the suction port 150*a* to the discharge port 150*b* more smoothly in the restarting of the system than the system including the comparative pump arranged in the horizontal posture, even when the liquid surface of the working fluid is at a low level or Level 1.

In this manner, the working fluid cooled in the condenser is allowed to smoothly enter into the casing 150 of the pump 15 even in stopping of the binary cycle power generation system 1, so that the working fluid is kept from coming into the saturation state around the suction port 150*a*. The binary cycle power generation system 1 having this configuration in the first embodiment can prevent a cavitation from occurring in the casing 150 of the pump 15 in the restarting of the system 1.

As a result, the binary recycle power generation system 1 can prevent a cavitation from occurring in the casing 150 of the pump 15 in the restarting of the system 1, and therefore can further avoid malfunction.

Moreover, as described above, the working fluid is allowed to smoothly flow into the casing 150 of the pump 15 in this embodiment in the restarting of the system 1. Hence, it is possible to prevent a gas from accumulating in the casing 150.

Therefore, the binary cycle power generation system 1 according to this embodiment can avoid damage attributed to the accumulating gas to the pump.

The binary cycle power generation system 1 according to the first embodiment consequently can avoid damage accompanied by the restarting of the system 1 to the bearing 154 of the pump 15, thereby achieving a high and long-term reliability.

4-2. Comparative Example

In contrast, as described with reference to FIG. 5, the comparative pump 95 is arranged in the vertical posture in such a way that the axis $Ax_{95}$ of the rotary shaft 951 extends in the vertical direction (Z direction). In this arrangement, the liquid surface of the working fluid is required to be at a high level or Level 2 as shown in FIG. 5 in the inside passage 92*a* of the pipe 92 for the purpose of filling the casing 950 with the working fluid to start the pump 95.

If the liquid surface of the working fluid is at a lower level than Level 2 in the inside passage 92*a* of the pipe 92 and the working fluid is insufficient to fill an inside of the casing 950, a cavitation may occur in the casing 950 when starting the pump 95 in the restarting of the system. The occurrence of the cavitation in the casing 950 may cause a gas to accumulate in an upper region (denoted by an arrow A) in the inside of the casing 950 in the Z direction.

The accumulating gas in the upper region in the inside of the casing 950 in the Z direction as described above is likely to damage, for example, the bearing 954 due to the heat generated by the rotating rotary shaft 951, the bearing 954 facing the upper region containing the accumulating gas in the Z direction across the end wall 950*e* outside.

Furthermore, such gas accumulation is likely to occur when starting the pump 95 in the binary cycle power generation system including the comparative pump 95 and thus hinder the working fluid from smoothly flowing out from the discharge port 950*b*, which results in malfunction of the system.

Second Embodiment

1. Overall Configuration

An overall configuration of a binary cycle power generation system 3 according to a second embodiment will be described with reference to FIG. 6. The same structural components shown in FIG. 6 as those of the binary cycle power generation system 1 according to the first embodiment are given with the same reference signs, and the descriptions about these components will be omitted hereafter.

Figure 6:
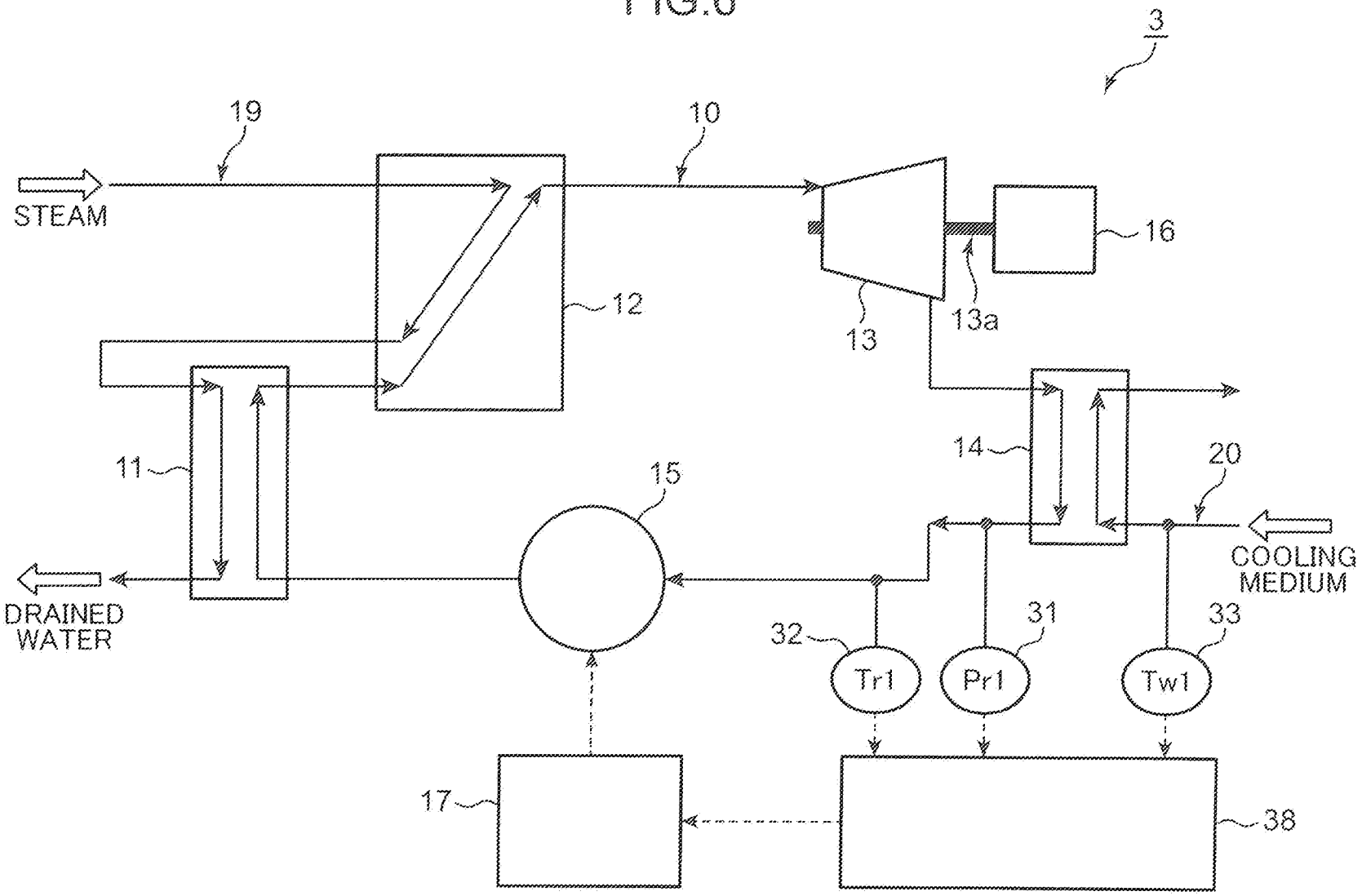
FIG. 6 is a schematic diagram showing a configuration of a binary cycle power generation system according to a second embodiment.

As shown in FIG. 6, the binary cycle power generation system 3 according to this embodiment includes a working fluid circulation line 10, a preheater 11, an evaporator 12, an expander 13, a condenser 14, a pump 15, a power generator 16, an inverter 17, and a controller (control unit) 38. The binary cycle power generation system 3 according to this embodiment further includes a pressure detector 31, a temperature detector 32, and a cooling temperature detector 33.

The pressure detector 31 is a detector which is provided in a portion between the condenser 14 and the pump 15 in the working fluid circulation line 10, and detects a pressure of the working fluid at an outlet of the condenser 14.

The temperature detector 32 is a detector which is provided in a portion between the condenser 14 and the pump 15 in the working fluid circulation line 10 similarly to the pressure detector 31, and detects a temperature of the working fluid at the outlet of the condenser 14.

The cooling temperature detector 33 is a sensor which is provided at a supply port to the condenser 14 in a cooling medium circulation line 20 connected to the condenser 14, and detects a temperature of a cooling medium (e.g., cooling water) supplied to the condenser 14.

Like the controller 18, the controller 38 outputs a signal to the inverter 17 and controls driving of the motor 153 of the pump 15. The controller 38 differs from the controller 18 in the first embodiment in that the controller 38 receives the pressure information from the pressure detector 31, the temperature information from the temperature detector 32, and the cooling temperature information from the cooling temperature detector 33 one after another, and further utilizes the received information to control the driving (and stopping) of the motor 153.

2. Control Executed by Controller 38 when Stopping System

Control executed by the controller 38 when stopping the binary cycle power generation system 3 according to this embodiment will be described with reference to FIG. 7.

Figure 7:
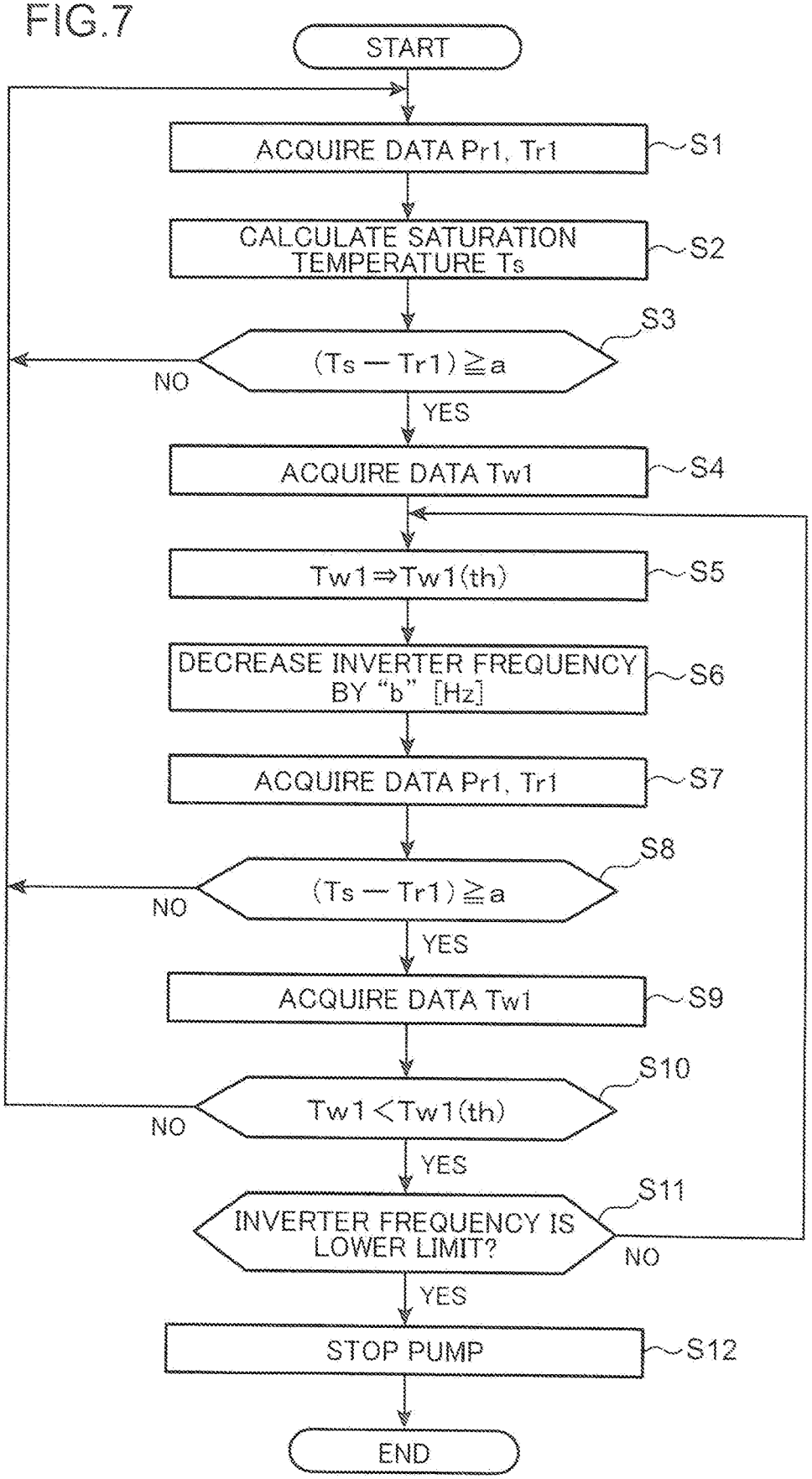
FIG. 7 is a flowchart showing a control flow executed by a controller in the binary cycle power generation system according to the second embodiment when stopping the system.

As shown in FIG. 7, the controller 38, when stopping the system, firstly acquires pressure information Pr1 and temperature information Tr1 of the working fluid at the outlet of the condenser 14 in the working fluid circulation line 10 respectively from the pressure detector 31 and the temperature detector 32 (step S1). The controller 38 may acquire the pressure information Pr1 and the temperature information Tr1 timelessly or only when stopping the system. In this embodiment, the controller 38 is configured to acquire the pressure information Pr1 and the temperature information Tr1 one after another.

Next, the controller 38 calculates a saturation temperature Ts from the acquired pressure information (a pressure of the working fluid at the outlet of the condenser 14) Pr1 (step S2). Subsequently, the controller 38 calculates a supercooling degree (Ts−Tr1) or a difference between the calculated saturation temperature Ts and the acquired temperature information (a temperature of the working fluid at the outlet of the condenser 14), and determines whether the supercooling degree (Ts−Tr1) is a predetermined (target) value "a" [° C.] or more (step S3).

The controller 38 re-executes steps S1 to S3 when the determination in step S3 results in (Ts−Tr1)<"a" ("No" in step S3).

It should be noted that the predetermined value of the supercooling degree "a" [° C.] in the determination in step S3 falls within a range of, for example, 1.0 [° C.] to 2.0 [° C.].

Conversely, the controller 38 acquires, from the cooling temperature detector 33, cooling temperature information (a temperature of the cooling medium supplied to the condenser 14) Tw1 (step S4) when the determination results in (Ts−Tr1)≥"a" relative to the saturation temperature ("Yes" in step S3). The controller 38 further temporally stores the acquired cooling temperature information Tw1 as Tw1 (th) (step S5), and outputs to the inverter 17 an instruction of decreasing an inverter frequency of power supplied to the motor 153 of the pump 15 by a predetermined value "b" [Hz] (step S6), thereby reducing the rotational speed of the motor 153 of the pump 15 by 120× b/p (rpm). The reference sign "p" denotes the pole number of the motor 153.

The predetermined value "b" [Hz] falls within a range of, for example, 0.5 to 1.0 [Hz] in this embodiment.

Thereafter, the controller 38 reacquires pressure information Pr1 and temperature information Tr1 of the working fluid at the outlet of the condenser 14 in the working fluid circulation line 10 at the time of having decreased the inverter frequency (step S7). The controller 38 recalculates a supercooling degree (Ts−Tr1) or a difference between a saturation temperature Ts and the acquired temperature information Tr1 by using the acquired temperature information Tr1, and determines whether the recalculated supercooling degree (Ts−Tr1) is the predetermined (target) value "a" [° C.] or more (step S8). When the determination in step S8 results in (Ts−Tr1)≥"a" ("Yes" in step S8), the controller 38 acquires cooling temperature information Tw1 of the cooling medium (step S9), and determines whether the acquired cooling temperature information Tw1 is lower than the cooling temperature information Tw1 (th) stored in step 5, that is, lower than the cooling temperature information Tw1 acquired before decreasing the inverter frequency (step S10).

The controller 38 returns to step S1 and re-executes the control when the determination in either step S8 or S10 results in "No".

Meanwhile, the controller 38 subsequently determines whether the inverter frequency of the inverter 17 is less than a lower limit (step S11) when both the determinations in the steps S8 and S10 result in "Yes". The controller 38 stops the driving of the motor 153 of the pump 15 (step S12) when the inverter frequency of the inverter 17 is determined to be less than the lower limit ("Yes" in step S11).

The controller 38 repeats steps S5 to S11 when the inverter frequency is determined to be the lower limit or more in step S11 ("No" in step S11).

As described above, the controller 38 in this embodiment reduces the rotational speed of the motor 153 of the pump 15 in a stepwise way, while keeping at the predetermined value "a" [° C.] or more the supercooling degree (Ts−Tr1) based on the acquired three pieces of information (pressure information Pr1, temperature information Tr1, and cooling temperature information Tw1), until the system stops.

3. Advantageous Effects

The binary cycle power generation system 3 according to this embodiment permits the controller 38 to, by executing the control shown in FIG. 7, reduce the rotational speed of the motor 153 of the pump 15 in a stepwise or gradual way, while keeping at the predetermined value "a" [° C.] or more the supercooling degree (Ts−Tr1) or a difference between the saturation temperature Ts and the temperature Tr1 of the working fluid at the outlet of the condenser 14 and reducing the pressure of the working fluid at the outlet of the condenser 14, until the system stops. Therefore, the system 3 can prevent a cavitation from occurring in the pump 15 in the restarting of the system 3, and further avoid malfunction.

As described above, if the pump abruptly stops in a state that the condenser has a high temperature, the pressure of the working fluid at a downstream position of the condenser rapidly decreases, but the temperature in the condenser remains high, so that the working fluid comes into a saturation state. The working fluid at the suction port of the pump comes consequently into the saturation state. The working fluid at the suction port of the pump comes into a superheated state when the system is restarted in this situation. As a result, a cavitation is likely to occur.

In contrast, the motor 153 of the pump 15 in the binary cycle power generation system 3 according to this embodiment is configured to stop the system by reducing the rotational speed of the motor 153 of the pump 15 in a stepwise or gradual way, while keeping at the predetermined value "a" [C° ] or more the supercooling degree (Ts−Tr1) or the difference between the saturation temperature Ts and the temperature Tr1 of the working fluid at the outlet of the condenser 14 and reducing the pressure of the working fluid at the outlet of the condenser 14. This configuration makes it possible to keep the working fluid at the suction port 150*a* of the pump 15 from coming into the superheated state in the stopping of the system 3, and prevent a cavitation from occurring in the casing 150 of the pump 15 in the restating of the system 3.

Furthermore, the binary cycle power generation system 3 according to this embodiment including the pump 15 arranged in the horizontal posture in the same manner as the first embodiment allows the working fluid to flow from the suction port 150*a* to the discharge port 150*b* more smoothly in the restarting of the system 3 than the system including the comparative pump arranged in the vertical direction, even when the liquid surface of the working fluid is at a low level or Level 1. Accordingly, the binary cycle power generation system 3 according to this embodiment can prevent a cavitation from occurring in the casing 150 of the pump 15 in the restarting of the system 3 as well as the binary cycle power generation system 1.

Consequently, the binary cycle power generation system 3 according to this embodiment can reliably prevent a cavitation from occurring in the casing 150 of the pump 15 in the restarting of the system 3, and further avoid malfunction and damage to the pump 15 by adopting the above-described control by the controller 38 in combination with the same configuration and arrangement of the pump 15 according to the first embodiment.

Third Embodiment

1. Configuration

An overall configuration of a binary cycle power generation system 5 according to a third embodiment will be described with reference to FIG. 8. The same structural components shown in FIG. 8 as those of the binary cycle power generation systems 1 and 3 respectively according to the first and second embodiments are given with the same reference signs, and the descriptions about these components will be omitted hereafter.

Figure 8:
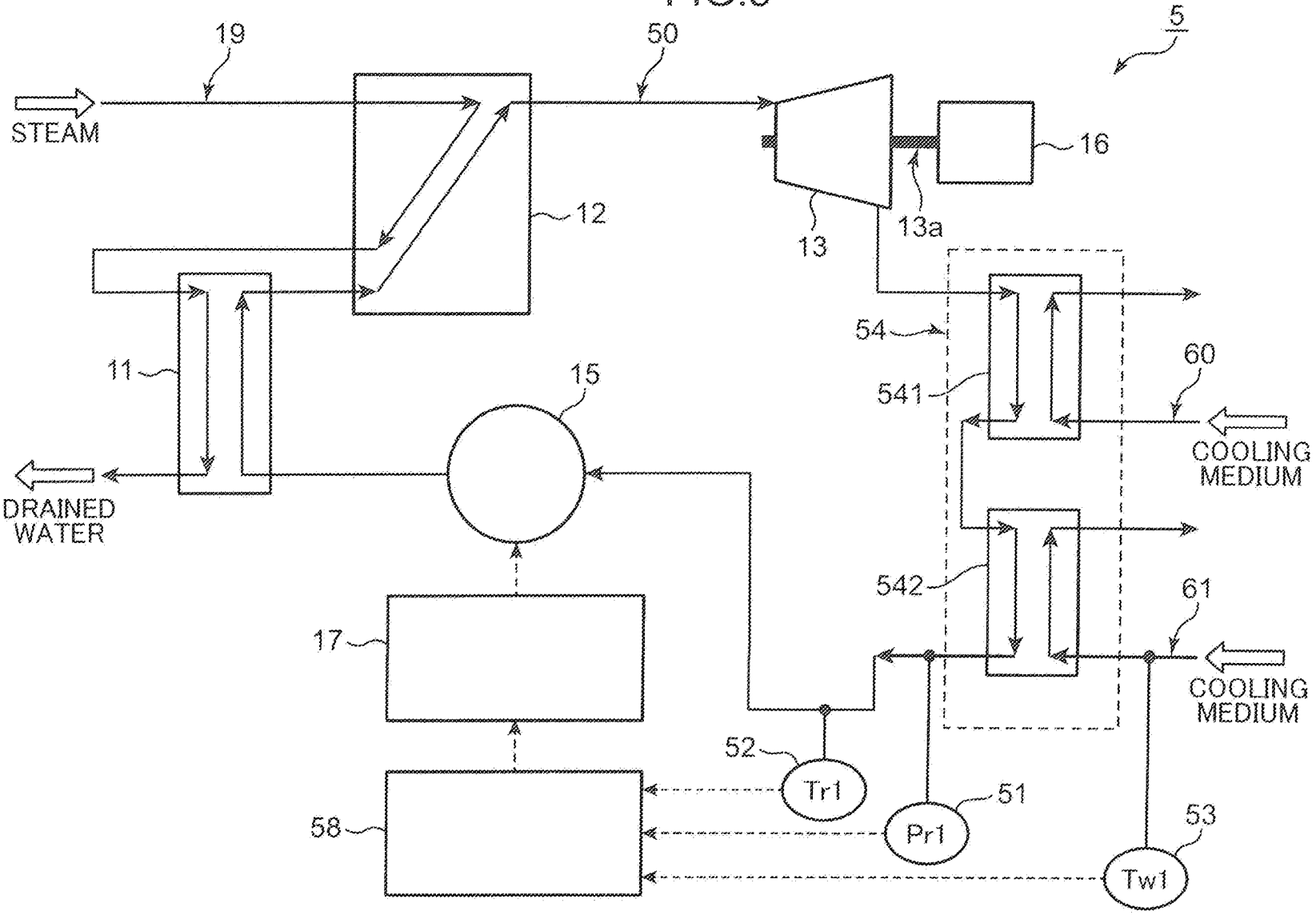
FIG. 8 is a schematic diagram showing a configuration of a binary cycle power generation system according to a third embodiment.

As shown in FIG. 8, the binary cycle power generation system 5 according to this embodiment includes a working fluid circulation line 50, a preheater 11, an evaporator 12, an expander 13, a condenser 54, a pump 15, a power generator 16, an inverter 17, and a controller (control unit) 58. The binary cycle power generation system 5 further includes a pressure detector 51 and a temperature detector 52 provided at an outlet of the condenser 54 in the working fluid circulation line 50, and a cooling temperature detector 53 which detects a temperature of a cooling medium supplied to the condenser 54.

The pressure detector 51, the temperature detector 52, and the cooling temperature detector 53 in the binary cycle power generation system 5 according to this embodiment basically have the same functions as the pressure detector 31, the temperature detector 32, and the cooling temperature detector 33 in the binary cycle power generation system 3 according to the second embodiment.

As shown in FIG. 8, the condenser 54 in this embodiment includes a first condensing part 541 and a second condensing part 542 connected with each other in series in the working fluid circulation line 50. The first condensing part 541 is provided at an upstream position and the second condensing part 542 is provided at a downstream position in the working fluid circulation line 50.

The first condensing part 541 is supplied with a cooling medium (e.g., cooling water) via a cooling medium circulation line 60, and the second condensing part 542 is supplied with a cooling medium (e.g., cooling water) via a cooling medium circulation line 61.

The first condensing part 541 and the second condensing part 542 cool the working fluid by using the cooling medium in the binary cycle power generation system 5 according to this embodiment even in stopping of the system.

The pressure detector 51 and the temperature detector 52 are provided at the outlet of the second condensing part 542 in the working fluid circulation line 50. In other words, the pressure detector 51 and the temperature detector 52 are provided at the outlet of the condenser 54 in the working fluid circulation line 50.

The cooling temperature detector 53 is provided in the cooling medium circulation line 61 to the second condensing part 542 provided at a downstream position in the working fluid circulation line 50, and detects a temperature of the cooling medium supplied to the second condensing part 542.

Like the second embodiment, the controller 58 is configured to stop the system by reducing a rotational speed of a motor 153 of the pump 15 in a stepwise way while keeping at a predetermined value "a" [° C.] or more a supercooling degree (Ts−Tr1) or the difference between the saturation temperature Ts and the temperature Tr1 of the working fluid at the outlet of the condenser based on acquired three pieces of information (pressure information Pr1, temperature information Tr1, and cooling temperature information Tw1), until the system stops. The controller 58 performs the same control as shown in FIG. 7.

2. Advantageous Effects

The binary cycle power generation system 5 according to this embodiment, as well as the second embodiment, permits the controller 58 to reduce the rotational speed of the motor 153 of the pump 15 in a stepwise, while keeping at the predetermined value "a" [° C.] or more the supercooling degree (Ts−Tr1) calculated based on the temperature Tr1 of the working fluid at the outlet of the condenser 54, until the system stops. Accordingly, the system 5 can prevent a cavitation from occurring in the pump 15 in the restarting of the system 5, and further avoid malfunction.

Moreover, the binary cycle power generation system 5 according to this embodiment including the pump 15 arranged in the horizontal posture can prevent a cavitation from occurring in the casing 150 of the pump 15 in the restarting of the system 5 in the same manner as the first and second embodiments.

Furthermore, the binary cycle power generation system 5 according to this embodiment including the condenser 54 constituted by the first condensing part 541 and the second condensing part 542 connected with each other in series in the working fluid circulation line 50 makes it possible to more efficiently cool the working fluid to go to the pump 15. In other words, the binary cycle power generation system 5 according to this embodiment permits the first condensing part 541 and the second condensing part 542 to condense the working fluid coming from the expander 13 in two stages respectively.

In this manner, it is possible to easily keep at the predetermined value or more the supercooling degree of the working fluid in the pump 15 when stopping the system, and adjust the supercooling degree of the working fluid at the suction port 150*a* of the pump 15 to an effective net positive suction head (NPSH) or more in the restarting of the system 5.

Hence, the second condensing part 542 of the condenser 54 in this embodiment serves as a supercooler, and therefore is preferential to stop the system while keeping at the predetermined value "a" [° C.] or more the supercooling degree (Ts−Tr1) calculated from a saturation temperature Ts and a temperature Tr1 of the working fluid at the outlet of the condenser 54.

Consequently, the binary cycle power generation system 5 according to this embodiment can reliably prevent a cavitation from occurring in the casing 150 of the pump 15 in the restarting of the system and further avoid malfunction and damage to the pump 15 by adopting the above-described control by the controller 58 when stopping the system, in the same manner as the second embodiment, in combination with the same configuration and arrangement of the pump 15 in the first and second embodiments.

Modifications

Although the steam is supplied to the evaporator 12 via the steam supply line 19 in the first to third embodiments, the present invention should not be limited thereto. For example, warm water or an exhaust gas may be supplied to the evaporator 12.

Alternatively, an oil having a specified temperature may be supplied to the evaporator 12.

Although the preheater 11 and the evaporator 12 are provided between the pump 15 and the expander 13 in the working fluid circulation line 10, 50 in the first to third embodiments, the present invention should not be limited thereto. For example, only the evaporator may be provided between the pump and the expander in the working fluid circulation line.

Although the power generator 16 serving as an exemplary energy recovery apparatus is adopted in the first to third embodiments, the present invention should not be limited thereto. For example, a compressor which compresses a gas or a liquid owing to a gained thermal energy is adoptable.

Although the inverter frequency is decreased to reduce the rotational speed of the motor 153 of the pump 15 in the second and third embodiments, the present invention should not be limited thereto. For example, a control of reducing an applied voltage in addition to the decreasing of the inverter frequency, i.e., a control based on an adjustable voltage adjustable frequency (AVAF), is adoptable.

Moreover, the rotational speed of the motor 153 of the pump 15 is reduced in a gradual way in accordance with a decrease in the clock frequency for the control of the controller 38, 58 in the second and third embodiments. The technical scope of the present invention should cover the features that a rotational speed of a motor of a pump is reduced in a stepwise way, and that the rotational speed is reduced in a gradual way.

Although the pump 15 is arranged in such a way that the axis $Ax_{15}$ of the rotary shaft 151 extends in the horizontal direction in each of the binary cycle power generation systems 1, 3, 5 according to the first to third embodiments, the present invention should not be limited thereto. Specifically, the $Ax_{15}$ of the rotary shaft 151 of the pump 15 may permissibly intersect a vertical direction (Z direction) at other angles in the present invention. For example, the axis $Ax_{15}$ of the rotary shaft 151 may intersect the vertical direction (Z direction) at an angle of 75° or more to less than 90°. This arrangement makes it possible to prevent a cavitation from occurring in the casing 150 of the pump 15 in the restarting of the system more effectively than the arrangement of the comparative pump 95 where the axis $Ax_{95}$ of the rotational shaft 951 extends in the vertical direction as shown in FIG. 5.

Although six impellers 152 are attached to the rotary shaft 150 in the pump 15 in the first to third embodiments, the present invention should not be limited thereto. Two to five, or seven or more impellers may be attached to the rotary shaft.

Although the motor 153 is adopted as a drive source of the pump 15 in the first to third embodiments, the present invention should not be limited thereto. For example, an internal combustion engine such as a gasoline engine and a diesel engine, a gas turbine, or an actuator driven owing to an air pressure or a hydraulic pressure is adoptable. Furthermore, it is not necessarily required to include a motor as a structural component of the pump. Instead, the pump may be driven by a torque from an external drive source.

Although a cantilever structure that the one end of the rotary shaft 151 of the pump 15 is supported is adopted in the first to third embodiments, the present invention should not be limited thereto. A both-end holding structure may be adopted.

Although the controller 38, 58 is configured to execute the above-described control in addition to the arrangement of the pump 15 in the second and third embodiments, the present invention should not be limited thereto. For example, the comparative pump 95 shown in FIG. 5 is adoptable in the system. Even in this adoption, it may be possible to substantially suppress occurrence of a cavitation in restarting of the system by way of execution of the control by the controller as shown in FIG. 7.

However, as described above with reference to FIGS. 2 to 5, the arrangement where the axis $Ax_{15}$ of the rotary shaft 151 of the pump 15 intersects the vertical direction (Z direction) is advantageous in that a cavitation can be kept from occurring in restarting of the system.

Moreover, another type of pump other than the centrifugal pump may be adopted in the execution of the control in the second and third embodiments. For example, a gear pump, a vane pump, or a positive displacement pump such as a screw pump is adoptable.

Although each of the pressure detector 31, 51, the temperature detector 32, 52, and the cooling temperature detector 33, 53 is singly provided in the second and third embodiments, the present invention should not be limited thereto. For example, two or more detectors may be respectively provided to calculate average values thereof and further execute the control by using the average values, thereby enabling the control to be more precise.

Although a countercurrent-type heat exchanger is used as a heat exchanger for each of the preheater 11, the evaporator 12, the condenser 14, 54 in the first to third embodiments, the present invention should not be limited thereto. For example, a parallel flow-type heat exchanger or a cross flow-type heat exchanger is adoptable.

ASPECTS OF PRESENT INVENTION

A binary cycle power generation system according to an aspect of the present invention includes a working fluid circulation line, an evaporator, an expander, an energy recovery apparatus, a condenser, and a pump.

The working fluid circulation line is a line through which a working fluid circulates.

The evaporator is a structural component which is provided in the working fluid circulation line, and evaporates the working fluid owing to a gained thermal energy.

The expander is a structural component which is provided at a downstream side with respect to the evaporator in the working fluid circulation line, and expands the working fluid coming from the evaporator.

The energy recovery apparatus is a structural component which recovers a kinetic energy generated in the expander.

The condenser is a structural component which is provided at a downstream side with respect to the expander in the working fluid circulation line, and condenses the working fluid coming from the expander owing to a heat exchange with a cooling medium.

The pump is a structural component which is provided at a position downstream to the condenser and upstream to the evaporator in the working fluid circulation line, and causes the working fluid coming from the condenser to go to the evaporator.

The pump includes a casing, a rotary shaft, and impellers.

The casing is hollow and has an end wall at an end in a longitudinal direction.

The rotary shaft is a structural component which has an axis extending in the longitudinal direction, which is supported on the end wall, at least a part of which is in the casing, and which rotates owing to a torque.

The impellers are structural components attached to the rotary shaft one after another in the longitudinal direction.

The pump is arranged in such a way that the axis of the rotary shaft intersects a vertical direction.

The binary cycle power generation system according to this aspect includes the pump arranged in such a way that the axis of the rotary shaft intersects the vertical direction. Hence, the binary cycle power generation system according to this aspect can prevent a cavitation from occurring in the casing of the pump in the restarting of the system more effectively than a conventional system including a pump arranged in such a way that an axis of a rotary shaft extends in a vertical direction.

Specifically, the arrangement of the pump where the axis of the rotary shaft intersects the vertical section enables the working fluid to flow in the casing in the restarting of the system more smoothly than the arrangement of the pump where the axis of the rotary shaft extends in the vertical direction. The working fluid is cooled in the condenser even in the stopping of the system and the cooled working fluid flows in the casing of the pump, so that the working fluid is kept from coming into the saturation state around the suction port. In this way, it is possible to prevent a cavitation from occurring in the casing of the pump in the restarting of the system.

Consequently, the binary cycle power generation system according to this aspect can prevent a cavitation from occurring in the casing of the pump in the restarting of the system, and therefore ensure to cause the working fluid to go to the evaporator, and further avoid malfunction.

As described above, the pump in this aspect makes it possible to suppress occurrence of a cavitation in the restarting, and therefore prevent a gas from accumulating and further reliably avoid damage thereto in the restarting. In other words, the binary cycle power generation system according to this aspect including the pump arranged in such a way that the axis of the rotary shaft intersects the vertical direction allows the working fluid to flow more smoothly when starting the pump than the system including the pump arranged in such a way that the axis of the rotary shaft extends in the vertical direction, thereby rapidly cooling the inside of the casing. In this manner, the system according to this aspect can suppress occurrence of a cavitation and prevent the gas from accumulating, and thus avoid damage attributed to the accumulating gas to the pump.

Accordingly, the binary cycle power generation system according to this aspect can avoid damage accompanied by the restarting of the system to the pump, thereby achieving a high and long-term reliability.

In a binary cycle power generation system according to another aspect of the present invention having the above-described configuration, the pump is arranged in such a way that the axis of the rotary shaft intersects the vertical direction at an angle of 75° to 90°.

The binary cycle power generation system according to this aspect is effective to prevent a cavitation due to the working fluid from occurring in the pump in the restarting of system by way of the arrangement of the pump where the axis of the rotary shaft intersects the vertical direction at an angle of 75° to 90°. In this aspect, specifically, the pump is arranged in a lying state in the substantially horizontal direction (in a substantially horizontal state), and similarly, the flow passages of the working fluid in the casing extend in a substantially horizontal direction (in a substantially horizontal state).

In this arrangement, the working fluid is allowed to smoothly flow in the casing of the pump in the restarting of the system even in a situation that the liquid surface of the working fluid is at a low level and the inside of the pump is not always filled with the working fluid when the system is stopped. Accordingly, as described above, the system can prevent a cavitation from occurring in the casing of the pump, and further avoid malfunction and damage to the pump.

A binary cycle power generation system according to still another aspect of the present invention having the above-described configuration further includes a controller which controls driving of the pump, wherein the controller reduces a rotational speed of a motor of the pump in a stepwise or gradual way, while keeping at a predetermined value or more a supercooling degree calculated based on a saturation temperature and a temperature of the working fluid between the condenser and the pump in the working fluid circulation line, and then stops the system.

The binary cycle power generation system according to this aspect is configured to reduce the rotational speed of the motor of the pump in a stepwise or gradual way, while keeping at the predetermined value or more a supercooling degree based on the saturation temperature and the temperature of the working fluid at the outlet of the condenser, and then stop the system. Therefore, the system can suppress occurrence of a cavitation in the restarting of the system, and further avoid malfunction.

Meanwhile, if the pump is stopped in a state that the condenser has a high temperature, the pressure of the working fluid at a downstream position of the condenser rapidly decreases, but the temperature in the condenser remains high, so that the working fluid comes into a saturation state. The working fluid at the suction port of the pump comes into a superheated state when the system is restarted in this situation. As a result, a cavitation is likely to occur in the casing of the pump.

In contrast, the binary cycle power generation system according to this aspect is configured, as described above, to reduce the rotational speed of the motor of the pump in a stepwise or gradual way, while keeping at the predetermined value or more a supercooling degree calculated from the saturation temperature and the temperature of the working fluid at the outlet of the condenser, until the system stops. Accordingly, it is possible to avoid the superheated state at the suction port of the pump when stopping the system, and further prevent a cavitation from occurring in the casing of the pump in the restarting of the system.

A binary cycle power generation system according to further another aspect of the present invention having the above-described configuration additionally includes a pressure detector, a temperature detector, and a cooling temperature detector.

The pressure detector is a detector which is provided in a portion between the condenser and the pump in the working fluid circulation line, and detects a pressure of a working fluid in the specific portion.

The temperature detector is a detector which is provided in the portion between the condenser and the pump in the working fluid circulation line, and detects a temperature of the working fluid in the portion.

The cooling temperature detector is a detector which is provided in a supply line of the cooling medium to the condenser, and detects a temperature of the cooling medium in the supply line.

In this aspect, the controller sequentially executes the following operations:

a detection information reception: receiving temperature information from the temperature detector, pressure information from the pressure detector, and cooling temperature information from the cooling temperature detector one after another, a calculation: calculating a saturation temperature Ts from the pressure information (an acquired pressure of the working fluid at the outlet of the condenser);

a determination: determining whether a supercooling degree (Ts−Tr1) that is a difference between the saturation temperature Ts and a temperature Tr1 of the working fluid at the outlet of the condenser is a predetermined value "a" or more;

a rotational speed reduction: reducing a rotational speed of a motor of the pump by a predetermined value when the determination results in affirmation; and a cooling temperature comparison: comparing cooling temperature information (temperatures of the cooling medium) before and after the execution of the rotational speed reduction.

In this aspect, the controller repeats the rotational speed reduction and the cooling temperature comparison when the cooling temperature comparison results in that the cooling temperature information (a temperature of the cooling medium) after the execution of the rotational speed reduction is lower than the cooling temperature information (another temperature of the cooling medium) before the execution of the rotational speed reduction.

In this aspect, the specific control operations executed by the controller are defined to stop the pump in the stepwise or gradual way, while keeping at the predetermined value "a" or more the supercooling degree (Ts−Tr1) or a difference from the temperature Tr1 of the working fluid at the outlet of the condenser. The controller executing the above-described operations makes it possible to suppress the superheated state at the suction port of the pump when stopping the system, and further prevent a cavitation from occurring in the pump in the restarting of the system.

In a binary cycle power generation system according to still further another aspect of the present invention having the above-described configuration, the condenser includes a first condensing part and a second condensing part connected with each other in series, the first condensing part being provided at an upstream position and the second condensing part being provided at a downstream position in the working fluid circulation line, and the cooling temperature detector is provided in a supply line of the cooling medium to the second condensing part.

The condenser in the binary cycle power generation system according to this aspect is constituted by the first condensing part and the second condensing part connected with each other in series. In this aspect, in other words, the first condensing part and the second condensing part condense the working fluid coming from the expander in two stages respectively.

In this manner, it is possible to easily keep at the predetermined value or more the super cooling degree of the working fluid in the pump when stopping the system, and adjust the super cooling degree of the working fluid at the suction port of the pump to an effective net positive suction head (NPSH) or more in the restarting of the system.

Consequently, the binary cycle power generation system according to this aspect can further reliably prevent a cavitation from occurring in the pump in the restarting of the system.

In a method for stopping a binary cycle power generation system according to an aspect of the present invention, the binary cycle power generation system includes a working fluid circulation line, an evaporator, an expander, an energy recovery apparatus, a condenser, a pump, a temperature detector, a pressure detector, and a cooling temperature detector.

The working fluid circulation line is a line through which a working fluid circulates.

The evaporator is a structural component which is provided in the working fluid circulation line, and evaporates the working fluid owing to a gained thermal energy.

The expander is a structural component which is provided at a downstream position of the evaporator in the working fluid circulation line, and expands the working fluid coming from the evaporator.

The energy recovery apparatus is a structural component which recovers a kinetic energy generated in the expander.

The condenser is a structural component which is provided at a downstream position of the expander in the working fluid circulation line, and condenses the working fluid coming from the expander owing to a heat exchange with a cooling medium.

The pump is a structural component which is provided at a position downstream of the condenser and upstream of the evaporator in the working fluid circulation line, and causes the working fluid coming from the condenser to go to the evaporator.

The pressure detector is a detector which is provided in a portion between the condenser and the pump in the working fluid circulation line, and detects a pressure of the working fluid in the portion.

The temperature detector is a detector which is provided in a portion between the condenser and the pump in the working fluid circulation line, and detects the temperature of the working fluid in the portion.

The cooling temperature detector is a detector which is provided in a supply line of the cooling medium to the condenser, and detects a temperature of the cooling medium in the supply line.

The method for stopping the binary cycle power generation system according to this aspect includes the following steps to be sequentially executed:

a detection information reception step: receiving temperature information from the temperature detector, pressure information from the pressure detector, and cooling temperature information from the cooling temperature detector one after another, a calculation step: calculating a saturation temperature Ts from the pressure information (an acquired pressure of the working fluid at the outlet of the condenser);

a determination step: determining whether a supercooling degree (Ts−Tr1) that is a difference between the saturation temperature Ts and a temperature Tr1 of the working fluid at the outlet of the condenser is a predetermined value "a" or more;

a rotational speed reduction step: reducing a rotational speed of a motor of the pump by a predetermined value when the determination results in affirmation; and a cooling temperature comparison step: comparing cooling temperature information (temperatures of the cooling medium) before and after the execution of the rotational speed reduction step.

In this aspect, the rotational speed reduction step and the cooling temperature comparison step are repeated when the cooling temperature comparison results in that the cooling temperature information (a temperature of the cooling medium) after the execution of the rotational speed reduction is lower than the cooling temperature information (another temperature of the cooling medium) before the execution of the rotational speed reduction.

Conclusively, the binary cycle power generation system and the method for stopping the system according to the respective aspects of the present invention can prevent a cavitation from occurring in the pump in the restarting of the system.

The invention claimed is:

1. A binary cycle power generation system comprising:

a working fluid circulation line through which a working fluid circulates;

an evaporator provided in the working fluid circulation line, and configured to evaporate the working fluid owing to a gained thermal energy;

an expander provided at a downstream side with respect to the evaporator in the working fluid circulation line, and configured to expand the working fluid coming from the evaporator;

an energy recovery apparatus configured to recover a kinetic energy generated in the expander;

a condenser provided at a downstream side with respect to the expander in the working fluid circulation line, and configured to condense the working fluid coming from the expander owing to a heat exchange with a cooling medium;

a pump provided at a position downstream to the condenser and upstream to the evaporator in the working fluid circulation line, and configured to cause the working fluid coming from the condenser to go to the evaporator, and a controller configured to control driving of the pump, wherein the pump includes:

a hollow casing having an end wall at an end in a longitudinal direction;

a rotary shaft which has an axis extending in the longitudinal direction, which is supported on the end wall, at least a part of which is in the casing, and which rotates owing to a torque; and a plurality of impellers attached to the rotary shaft one after another in the longitudinal direction, the axis of the rotary shaft intersecting a vertical direction, and the controller reduces a rotational speed of a motor of the pump in a stepwise or gradual way, while keeping a supercooling degree at a predetermined value or more, wherein the supercooling degree is calculated based on a difference between a saturation temperature of the working fluid and a temperature of the working fluid at an outlet of the condenser between the condenser and the pump in the working fluid circulation line, until the binary cycle power generation system stops.

2. A binary cycle power generation system according to claim 1, wherein the axis of the rotary shaft intersects the vertical direction at an angle of 75° to 90°.

3. A binary cycle power generation system according to claim 1, further comprising:

a temperature detector provided in a portion between the condenser and the pump in the working fluid circulation line and configured to detect a temperature of the working fluid in the portion;

a pressure detector provided in the portion and configured to detect a pressure of the working fluid in the portion;

a cooling temperature detector provided in a supply line of the cooling medium to the condenser, and configured to detect a temperature of the cooling medium in the supply line, wherein the controller is configured to sequentially execute:

a detection information reception of receiving temperature information from the temperature detector, pressure information from the pressure detector, and cooling temperature information from the cooling temperature detector one after another;

a calculation of calculating a saturation temperature Ts from the pressure information;

a determination of determining whether a supercooling degree (Ts−Tr1) that is a difference between the saturation temperature Ts and a temperature Tr1 of the working fluid at the outlet of the condenser is a predetermined value or more;

a rotational speed reduction of reducing a rotational speed of a motor of the pump by a predetermined value when the determination results in affirmation; and a cooling temperature comparison of comparing cooling temperature information before and after the execution of the rotational speed reduction, the controller repeating the rotational speed reduction and the cooling temperature comparison when the cooling temperature comparison results in that the cooling temperature information after the execution of the rotational speed reduction is lower than the cooling temperature information before the execution of the rotational speed reduction.

4. A binary cycle power generation system according to claim 3, wherein the condenser includes a first condensing part and a second condensing part connected with each other in series, the first condensing part being provided at an upstream position and the second condensing part being provided at a downstream position in the working fluid circulation line, and the cooling temperature detector is provided in a supply line of the cooling medium to the second condensing part.

5. A method for stopping a binary cycle power generation system, the system including:

a working fluid circulation line through which a working fluid circulates;

an evaporator provided in the working fluid circulation line, and configured to evaporate the working fluid owing to a gained thermal energy;

an expander provided at a downstream side with respect to the evaporator in the working fluid circulation line, and configured to expand the working fluid coming from the evaporator;

an energy recovery apparatus configured to recover a kinetic energy generated in the expander;

a condenser provided at a downstream side with respect to the expander in the working fluid circulation line, and configured to condense the working fluid coming from the expander owing to a heat exchange with a cooling medium;

a pump provided at a position downstream of the condenser and upstream of the evaporator in the working fluid circulation line, and configured to cause the working fluid coming from the condenser to go to the evaporator;

a temperature detector provided in a portion between the condenser and the pump in the working fluid circulation line and configured to detect a temperature of the working fluid in the portion;

a pressure detector provided in the portion and configured to detect a pressure of the working fluid in the portion; and a cooling temperature detector provided in a supply line of the cooling medium to the condenser, and configured to detect a temperature of the cooling medium in the supply line, wherein the method, when stopping the system, sequentially execute:

a detection information reception step of receiving temperature information from the temperature detector, pressure information from the pressure detector, and cooling temperature information from the cooling temperature detector one after another;

a calculation step of calculating a saturation temperature Ts from the pressure information;

a determination step of determining whether a supercooling degree (Ts−Tr1) that is a difference between the saturation temperature Ts and a temperature Tr1 of the working fluid at the outlet of the condenser is a predetermined value or more;

a rotational speed reduction step of reducing a rotational speed of a motor of the pump by a predetermined value when the determination in the determination step results in affirmation; and a cooling temperature comparison step of comparing cooling temperature information before and after execution of the rotational speed reduction step, the rotational speed reduction step and the cooling temperature comparison step being repeated when the comparison in the cooling temperature comparison step results in that the cooling temperature information after the execution of the rotational speed reduction step is lower than the cooling temperature information before the execution of the rotational speed reduction step.

* * * * *